United States Patent [19]

Russel et al.

[11] 4,212,701

[45] Jul. 15, 1980

[54] PROCESS AND COMPOSITION OF LOW TOXICITY FOR PREPARING ALUMINUM SURFACES FOR ADHESIVE BONDING

[75] Inventors: William J. Russel, Sparta; Elizabeth A. Garnis, Franklin, both of N.J.

[73] Assignee: The United States of America as represented by the Secretary of the Army, Washington, D.C.

[21] Appl. No.: 37,210

[22] Filed: May 9, 1979

[51] Int. Cl.[2] ..... C23F 1/00

[52] U.S. Cl. ..... 156/665; 156/64; 156/306.9; 156/629; 252/79.2

[58] Field of Search ..... 134/3, 41; 252/79.2, 252/142; 427/307, 309; 204/33; 156/655, 307, 308, 64, 309

[56] References Cited

U.S. PATENT DOCUMENTS

| | | | |
|---|---|---|---|
| 2,945,778 | 7/1960 | Lipinski | 156/665 X |
| 3,140,203 | 7/1964 | Grunwald | 156/665 X |
| 3,785,866 | 1/1974 | Frey | 134/41 X |
| 4,100,015 | 7/1978 | Russell | 252/79.2 X |

*Primary Examiner*—William A. Powell

*Attorney, Agent, or Firm*—Nathan Edelberg; Robert P. Gibson; A. Victor Erkkila

[57] ABSTRACT

The invention provides a process and composition of low toxicity for preparing aluminum surfaces for adhesive bonding. The process involves treating the aluminum with an etching composition composed of sulfuric acid, ferric sulfate and water. The invention eliminates the toxicity and pollution problems associated with the conventional chromate-type etching baths, reduces the contamination of the work place and environment to acceptable levels, and produces aluminum surfaces, which when adhesively bonded yield joints comparable in strength to those obtained by use of the conventional chromate-type etchant bath.

5 Claims, 2 Drawing Figures

PROCESS AND COMPOSITION OF LOW TOXICITY FOR PREPARING ALUMINUM SURFACES FOR ADHESIVE BONDING

GOVERNMENTAL INTEREST

The invention described herein may be manufactured, used and licensed by or for the Government for Governmental purposes without payment to us of any royalties thereon.

BACKGROUND OF THE INVENTION

The present invention relates to a novel process and composition of low toxicity for the treatment of aluminum parts to produce surfaces, which can be adhesively bonded to other parts to produce durable joints.

The conventional procedure for preparing aluminum surfaces for adhesive bonding comprises etching the aluminum with an aqueous solution of sulfuric acid and sodium dichromate. The use of such etching solutions results in the contamination of the air in the etching room with fumes which are toxic and carcinogenic to workers. Equipment required to remove toxic fumes evolved during the etching process is expensive and often ineffective if accidental spills or equipment breakdowns occur. Spent chromate containing etchants and rinse waters must be treated chemically to reduce the chrominum to the trivalent state, then neutralized to precipitate the chrome and pumped to settling ponds where the chrome settled out as a sludge.

U.S. Pat. No. 4,100,015 discloses an improved etching bath for aluminum, which consists essentially of a mixture of nitric acid, sodium sulfate and ferric sulfate, and preferably also sulfuric acid. The bath contains no chromate but yet produces aluminum surfaces, which when adhesively bonded provide joint strengths comparable to those obtained using the standard chromate etch. However, while the bath reduces or eliminates the pollution and toxicity problems associated with the chromate bath, it leaves something to be desired, since during the etching of the metal the nitric acid evolves fumes including oxides of nitrogen, which are excessively toxic.

SUMMARY OF THE INVENTION

A principal object of the present invention is to provide a novel process and composition for etching aluminum, which utilizes neither chromate nor nitric acid and produces aluminum surfaces, which when adhesively bonded yield joints of comparable strength and stress durability to those obtained by use of either the standard chromate etch or the chromate-free nitric acid etch of the patent. Other objects will become apparent as the invention is further described.

These and other objects are achieved according to the present invention by contacting the aluminum parts with an etchant composition consisting essentially of an aqueous solution of sulfuric acid and ferric sulfate. Since the composition is devoid of chromates and nitric acid, it eliminates the toxicity and pollution problems associated with the use of etchant baths containing such materials and reduces the contamination of the work place and environment to acceptable levels. The spent etchant composition and rinse waters can be rendered safe by neutralization with inexpensive caustic soda or lime, which also precipitates the iron present therein.

DETAILED DESCRIPTION OF THE INVENTION

Figure 1:
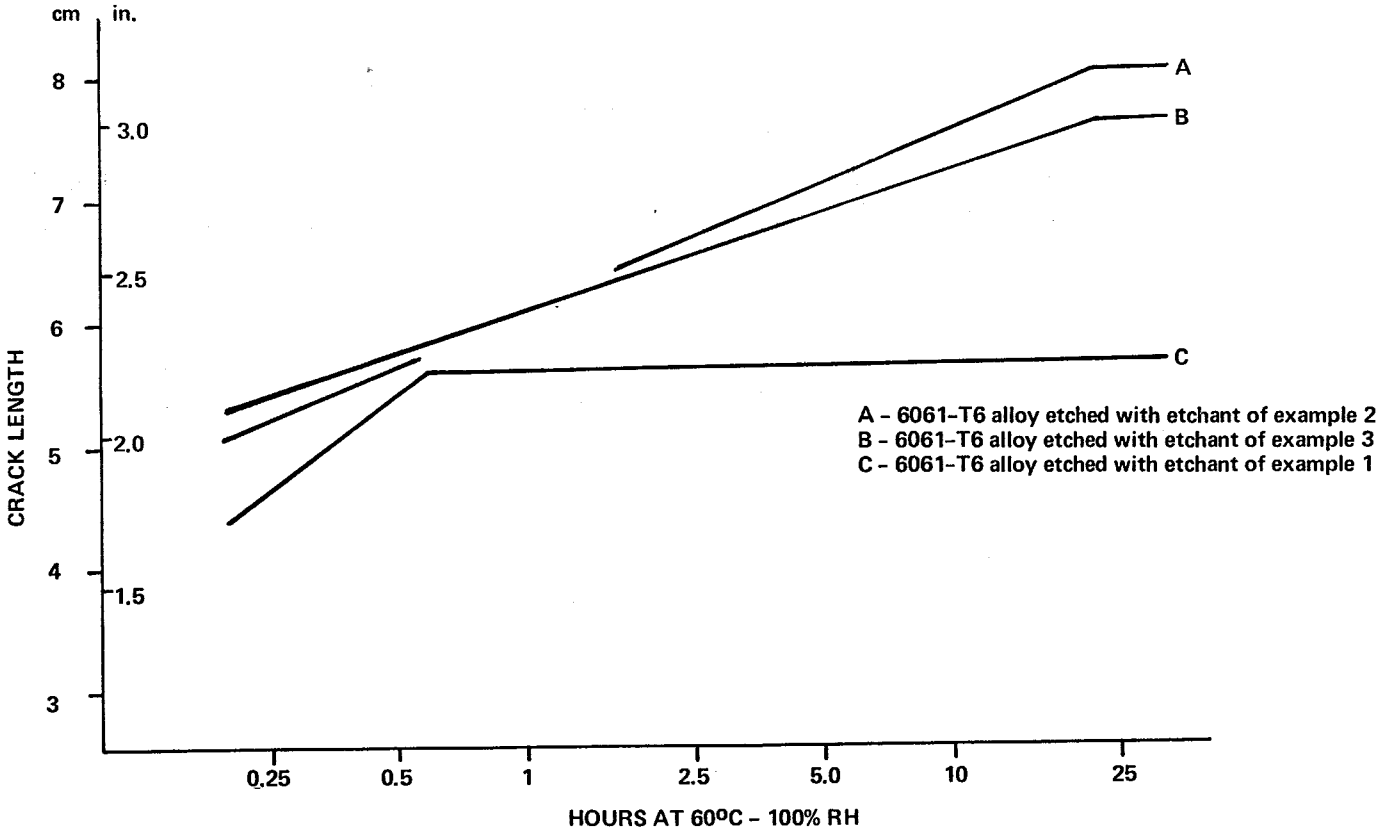
FIG. 1 sets forth a series of graphs comparing the durability of adhesive bonds obtained with the etchant of the present invention and prior art etchants.

The novel etchant compositions, which can be suitably employed in carrying out the process of the present invention, contain sulfuric acid, ferric sulfate and water in proportions equivalent to the following:

| | Weight Percent |
|---|---|
| sulfuric acid 96%, sp. gr. 1.84 | 25 to 35 |
| ferric sulfate 75% | 5 to saturated solution |
| water | 50 to 70 |

Preferred etchant compositions contain about 28 to 30 weight percent sulfuric acid 96%, about 10 to 14 weight percent ferric sulfate 75% and about 58 to 62 weight percent water.

The process of the present invention can be carried out by contacting the aluminum (which term includes pure or substantially pure aluminum as well as aluminum alloys consisting predominately of aluminum) with the novel etchant solution for a suitable period under a wide range of temperatures, eg. from 10° to 90° C. for about 5 to 30 minutes.

The following examples provide specific illustrations of the process and compositions of the present invention.

EXAMPLE 1

Preparation of the Novel Etchant 370 grams sulfuric acid 96%, sp. gr. 1.84, were slowly stirred into 500 milliliters of deionized water. 150 grams ferric sulfate 75% ($Fe_2(SO_4)_3.xH_2O$) were added. The mixture was then diluted to a volume of one liter with deionized water, and the resulting mixture was agitated until a complete solution was obtained. The etchant composition thus produced contained approximately 28.7% by weight 96% sulfuric acid, 11.6% by weight ferric sulfate 75% and 59.7% by weight water.

EXAMPLE 2

Preparation of the Etchant of U.S. Pat. No. 4,100,015

54.1 grams ferric sulfate 75% and 69.2 grams anhydrous sodium sulfate were dissolved in a mixture of 218 milliliters nitric acid 70% sp. gr. 1.41, 37.2 grams sulfuric acid 96%, and 500 ml deionized water, and the solution thus obtained was diluted to one liter with deionized water.

EXAMPLE 3

Preparation of Standard Chromate Etchant 33.3 grams sodium dichromate ($Na_2Cr_2O_7.2H_2O$) were dissolved in 332 grams sulfuric acid 96% sp. gr. 1.84 and 500 ml deionized water. The solution thus obtained was diluted by addition of one liter of deionized water.

Etching Procedure

The etchant compositions of examples 1–3 were employed for etching panels of various aluminum alloys of 1.54 mm (0.063 in..) thichness, which has been carefully cleaned with acetone to remove all ink and oil therefrom prior to immersion in the etchant bath.

Table 1

| Etchant | Composition of Etchants: Conc sulfuric acid (g) (sg 1.84) | Ferric sulfate 75% (g) | Sodium sulfate anhydrous (g) | Nitric acid conc (ml) | Sodium dichromate $Na_2Cr_2O_7 \cdot 2H_2O$ | Deionized water (L) | Etch temp (°C.) | Cycle time (min) |
|---|---|---|---|---|---|---|---|---|
| Example 1 | 370.0 | 150.0 | | | | * | 68 | 16 |
| Example 2 | 37.2 | 54.1 | 69.2 | 218 | | * | 66 ± 3 | 12 |
| Example 3 | 332.0 | | | | 33.3 | 1 | 68 ± 3 | 9 |

*Diluted with sufficient deionized water to one liter of etchant.

Table 1 shows the etching bath formulations, etching cycles and temperatures employed. After removal from the etching bath, the panels were rinsed with deionized water, and the surfaces were rapidly dried with a jet of filtered, compressed air to eliminate any variable due to uncontrolled reaction with the rinse water.

Adhesive Bond Tests

The etchant compositions of the examples were tested as to their effectiveness for the preparation of aluminum surfaces for adhesive bonding. Simple lap joints were tensile tested to failure to determine bond strength. Wedge tests were carried out to determine the durability of the adhesive bond under elevated temperature and humidity conditions. Shear stress tests were conducted to determine the stress durability of the bonded joints under elevated temperature and humidity conditions.

A. Tensile Tests

The test specimens were adhesively bonded using a thermosetting epoxy film adhesive AF126-3, which is marketed by the 3M Company and is cured at 121° C. in one hour at 50 psi. The bonded specimens were 2.5 cm (1 in.) wide and had an adhesive lap joint of 1.25 cm (0.5 in.). The tensile tests were conducted at approximately 50% relative humidity at room temperature (20°±2° C.) and at 60° C. but otherwise essentially according to the method described in ASTM D1002-72 Standard Method of Test for "Strength Properties of Adhesive in Shear by Tension Loading (Metal-to-Metal)." The aluminum specimens were of 6061-T6 aluminum alloy sheet (composition: about 0.6% silicon, 0.27% copper, 1.0% magnesium, 0.20% chromium, balance aluminum).

The test results are set forth in Table 2. They show that the bonds obtained with the etchant composition of the present invention were essentially equal in strength, or even slightly stronger, as compared to those obtained with the standard chromate etchant.

Table 2

| Etchant | 21° C. Load at Break (kg) | (lb) | (MPa)* | (psi) | 60° C. Load at Break (kg) | (lb) | (MPa)* | (psi) |
|---|---|---|---|---|---|---|---|---|
| Example 1 | 1200 | 2640 | 18.2 | 5280 | 835 | 1845 | 12.7 | 3690 |
| Example 1 | 1200 | 2640 | 18.2 | 5280 | 810 | 1785 | 12.3 | 3570 |
| Example 1 | 1190 | 2620 | 18.1 | 5240 | 815 | 1800 | 12.4 | 3600 |
| Example 1 | 1100 | 2420 | 16.7 | 4840 | 815 | 1795 | 12.4 | 3590 |

Table 2-continued

| Etchant | 21° C. Load at Break (kg) | (lb) | (MPa)* | (psi) | 60° C. Load at Break (kg) | (lb) | (MPa)* | (psi) |
|---|---|---|---|---|---|---|---|---|
| Average | 1170 | 2580 | 17.8 | 5160 | 820 | 1805 | 12.5 | 3610 |
| Example 3 | 1165 | 2565 | 17.7 | 5130 | 670 | 1480 | 10.2 | 2960 |
| Example 3 | 1140 | 2515 | 17.3 | 5030 | 825 | 1820 | 12.5 | 3640 |
| Example 3 | 1145 | 2520 | 17.4 | 5040 | 805 | 1775 | 12.2 | 3550 |
| Example 3 | 1160 | 2555 | 17.6 | 5110 | 725 | 1595 | 11.0 | 3190 |
| Average | 1150 | 2540 | 17.5 | 5080 | 760 | 1670 | 11.5 | 3340 |

*Megapascals

B. Wedge Tests

The wedge test specimens employed consisted of 6061-T6 aluminum alloy sheets 2.5 cm (1 in.) wide, 0.32 cm (0.125 in.) thick, and 20.4 cm (8 in.) long, etched in the manner described above. For bonding, a sandwich was prepared by placing a strip of the aforesaid epoxy film adhesive AF126-3 2.5 cm (1 in.) wide by 15 cm (5.9 in.) long and a strip of teflon film 2.5 cm (1 in.) wide by 5.4 cm (2.1 in.) long by 0.1 mm (0.004 in.) thick between two strips of the aluminum alloy sheets, such that after bonding, when the teflon film was removed, a rectangular bonded area 2.5 cm wide by 15 cm long was created between the two strips of metal.

Prior to testing, a wedge consisting of a strip of aluminum alloy 2.5 cm long, 1.0 cm wide and 0.32 cm thick (1×0.4×0.125 in.) was inserted into the unbonded area between the metal strips so that it was flush with the edges of the specimen sandwich and approached to 4 cm (1.6 in.) of the edge of the adhesive bonded area. The stressed specimen was then placed in a test chamber maintained at a temperature of 60° C. and 100% relative humidity. The growth of the crack which developed in the adhesive bond was monitored by removing the specimens from the test environment and locating the crack tip with the aid of a 40-power microscope. The location of the crack tip was scribed on both sides of the specimen, which was then returned to the test chamber for another test period.

The test results are shown graphically in FIG. 1. They show that the bonds obtained with the aid of the etchant of the present invention were superior to those obtained with either the standard chromate etchant or the chromate-free etchant of the patent.

C. Stress Durability Tests

The stress durability test evaluates the durability of the adhesive bond under shear stress at elevated temperature and humidity conditions rather than under the cleavage opening mode of the wedge stest. Also, the load on the specimen is often much greater that that experienced by the wedge specimen.

The 6061-T6 aluminum alloy test specimens employed were etched in the aforementioned manner, and adhesively bonded with a lap joint of 1.25 cm (0.5 in.), as described in the tensile tests.

The bonded speciments were tested for stress durability by placing each specimen in a spring-loaded jig and subjecting it to a test environment, including a temperature of 60° C. and an atmosphere of 95% relative humidity, essentially according to the method described in 20 ASTM D 2919-71, Standard Recommended Practice For Determining Durability of Adhesive Joints Stressed in Shear by Tension Loading. The time-to-failure for each specimen was automatically recorded.

Figure 2:
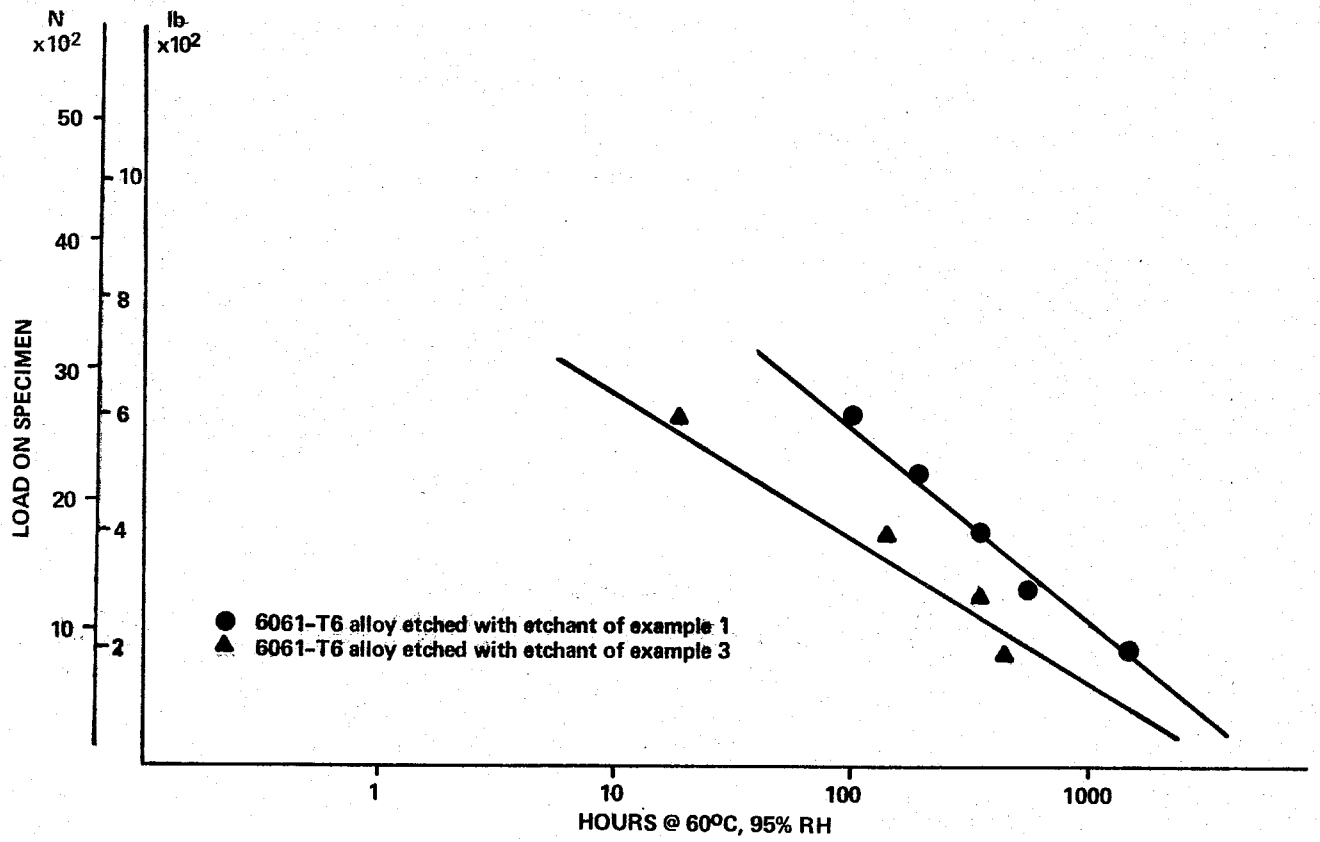
FIG. 2 illustrates a graphical comparison of the stress durability of adhesive bonds obtained with the etchant of the present invention and the standard chromate etchant.

The test results are set forth graphically in FIG. 2. The results show that the bonds obtained on specimens prepared with the etchant of the present invention were superior to those obtained with the standard chromate etchant.

The foregoing disclosure and drawings are merely illustrative of the principles of this invention and are not to be interpreted in a limiting sense. We wish it to be understood that we do not desire to be limited to the exact details of construction shown and described, because obvious modifications will occur to a person skilled in the art.

What is claimed is:

1. A process for adhesive bonding of aluminum parts, wherein the aluminum parts prior to bonding are subjected to an etching process to produce a surface preparatory to adhesive bonding, which comprises contacting the aluminum part with an etchant composition consisting essentially of about 25 to 35 weight percent sulfuric acid 96%
5 weight percent to saturated solution of ferric sulfate 75%
50 to 70 weight percent water.

2. A process according to claim 1, wherein the composition consists essentially of about 28 to 30 weight percent sulfuric acid 96%
10 to 14 weight percent ferric sulfate 75%
58 to 62 weight percent water.

3. A process according to claim 1, wherein the adhesive bonding is accomplished with an epoxy resin adhesive.

4. A composition for etching aluminum preparatory to adhesive bonding, which consists essentially of about 25 to 35 weight percent sulfuric acid 96%
5 weight percent to saturated solution of ferric sulfate 75%
50 to 70 weight percent water.

5. A composition according to claim 4, which consists essentially of 28 to 30 weight percent sulfuric acid 96%
10 to 14 weight percent ferric sulfate 75%
58 to 62 weight percent water.

* * * * *